US010279277B2

(12) United States Patent
Nelson et al.

(10) Patent No.: US 10,279,277 B2
(45) Date of Patent: May 7, 2019

(54) BALLOON HOLDER AND METHOD OF SHIPPING AND ASSEMBLING BALLOON HOLDERS

(71) Applicant: Premium Balloon Accessories, Inc., Sharon Center, OH (US)

(72) Inventors: David C. Nelson, Akron, OH (US); Wesley A. Schroeder, Seville, OH (US); Chase E. Nelson, Akron, OH (US)

(73) Assignee: PREMIUM BALLOON ACCESSORIES, INC., Sharon Center, OH (US)

( * ) Notice: Subject to any disclaimer, the term of this patent is extended or adjusted under 35 U.S.C. 154(b) by 0 days.

(21) Appl. No.: 15/149,466

(22) Filed: May 9, 2016

(65) Prior Publication Data

US 2017/0319976 A1 Nov. 9, 2017

(51) Int. Cl.
*A63H 3/06* (2006.01)
*A63H 27/10* (2006.01)

(52) U.S. Cl.
CPC ..... *A63H 27/10* (2013.01); *A63H 2027/1041* (2013.01)

(58) Field of Classification Search
CPC ..... A63H 27/10; A63H 2027/1041
USPC ..... 446/220, 222
See application file for complete search history.

(56) References Cited

U.S. PATENT DOCUMENTS 1,977,917 A * 10/1934 Norgren ..... F16L 33/213 285/148.16
2,840,948 A * 7/1958 Stickley ..... A63H 27/10 446/223
3,041,766 A * 7/1962 Decamp ..... A41G 1/00 403/361
3,088,242 A * 5/1963 Rockovits ..... A63H 27/10 383/3
3,174,455 A * 3/1965 Peterson ..... B64B 1/62 116/210
3,267,604 A * 8/1966 Goldsmith ..... A63H 27/10 446/222
3,333,844 A * 8/1967 Jurschak ..... A63B 23/18 137/102
3,616,569 A * 11/1971 Litt ..... A63H 27/10 446/220
4,589,854 A * 5/1986 Smith ..... A63H 27/10 40/214
4,661,081 A * 4/1987 Basseches ..... A63H 27/10 446/220

(Continued)

*Primary Examiner* — Alvin Hunter
*Assistant Examiner* — Joseph B Baldori
(74) *Attorney, Agent, or Firm* — Renner Kenner Greive Bobak Taylor & Weber

(57) ABSTRACT

A balloon holder includes a cup portion having a stem with a barb extending therefrom, and a conical cup defined by a sidewall extending from the stem to define a top edge of the conical cup. The balloon holder further includes a stick portion including an elongate stick body extending from a first end to a second end, a stem receptacle at the first end, and a barb receptacle provided in the stem receptacle, wherein a portion of the stem is received in the stem receptacle such that the barb locks into the barb receptacle to join the cup portion and the stick portion together to form a complete balloon holder.

13 Claims, 11 Drawing Sheets

(56) References Cited

U.S. PATENT DOCUMENTS 4,715,841 A * 12/1987 Nelson ..... A63H 27/10 24/545
4,715,874 A 12/1987 Nelson
4,729,749 A * 3/1988 Milne ..... A63H 27/10 428/24
4,798,554 A 7/1989 Nelson
4,881,916 A * 11/1989 Houser ..... A63H 27/10 446/220
4,884,987 A * 12/1989 Mason ..... A63H 27/10 446/225
4,895,545 A 1/1990 Nelson
5,021,022 A * 6/1991 Ganz ..... A63H 27/10 446/220
5,203,530 A * 4/1993 Liu ..... A63H 27/10 248/309.1
5,295,891 A * 3/1994 Schalk ..... A63H 27/10 362/806
5,395,276 A * 3/1995 Valentino ..... A63H 27/10 446/217
D360,844 S * 8/1995 Miller ..... D10/110
5,444,607 A * 8/1995 Dreyfuss ..... A63H 27/10 362/157
5,944,576 A 8/1999 Nelson
5,984,378 A * 11/1999 Ostrander ..... F16L 37/0985 285/319
6,079,922 A * 6/2000 Ross ..... F16B 13/122 411/180
6,176,758 B1 * 1/2001 Wu ..... A63H 3/06 446/220
6,375,534 B1 * 4/2002 Burns ..... A63H 27/10 40/212
6,575,806 B1 6/2003 Nelson
6,814,644 B2 11/2004 Nelson
6,969,295 B1 * 11/2005 Sidwell ..... A63H 27/10 446/220
7,588,477 B2 * 9/2009 Sidwell ..... A63H 27/10 446/220
7,850,328 B2 * 12/2010 Carito ..... A63H 27/10 362/184
7,854,642 B2 * 12/2010 Nelson ..... A63H 27/10 248/309.1
7,922,213 B2 * 4/2011 Werth ..... F16L 33/2071 285/242
8,152,588 B2 * 4/2012 Hua ..... A63H 27/10 446/220
8,968,047 B1 * 3/2015 Wicken ..... F16M 11/16 211/13.1
9,011,195 B2 * 4/2015 Sidwell ..... B65B 1/00 446/220
2005/0082826 A1 * 4/2005 Werth ..... A61M 39/12 285/243
2006/0289707 A1 * 12/2006 Greenwald ..... A63H 27/10 248/127
2006/0292960 A1 * 12/2006 Muller ..... A63H 27/10 446/220
2007/0049158 A1 * 3/2007 Chou ..... A63H 27/10 446/220
2008/0085656 A1 * 4/2008 Boise ..... A63H 27/10 446/220
2008/0148645 A1 * 6/2008 Rissone ..... E06B 7/2316 49/468
2012/0184175 A1 7/2012 Gilbert
2016/0003390 A1 * 1/2016 Harnetiaux ..... A01C 7/082 285/305

* cited by examiner

BALLOON HOLDER AND METHOD OF SHIPPING AND ASSEMBLING BALLOON HOLDERS

FIELD OF THE INVENTION

The present invention generally relates to balloon holders. Inasmuch as the balloon holders serve to hold and display inflated balloons, the present invention also relates to balloon displays. In a particular embodiment, the present invention relates to a method of shipping and assembling balloon holders.

BACKGROUND OF THE INVENTION

Exemplary balloon holder technology is provided in U.S. Pat. Nos. 4,895,545, 5,944,576, 6,575,806, and US2012/0184175. The U.S. Pat. Nos. 4,895,545 and 5,944,576 patents each teach a stick portion having a conical portion at one end thereof, the stick and conical portion being formed as one integral piece. This has been found to be undesirable when shipping such balloon holders. Particularly, while it is possible to lay a multitude of such balloon holders in a shipping container to ship them to a desired destination, it is often the case that many of the stick portions become warped in light of the spacing necessarily formed between neighboring balloon holders in light of the flaring of the cup portion from the stick portion. The warped sticks-which are typically formed of plastic in order to reduce costs—are not easily reshaped to the desired straight form. Because the straight stick is desired, it is difficult to sell the warped sticks, and this problem must be addressed in the art.

While U.S. Pat. No. 6,575,806 and US2012/0184175 teach separate stick portions and cup portions, with the stick portion and cup portion being selectively engaged to form a balloon holder, the engagement is readily compromised such that the cup can slip off of the stick. This is also undesirable and must be addressed in the art.

There is a need in the art for a balloon holder that can be shipped as separate stick portions and cup portions with those portions being joined in a manner that is not readily disassembled. There is a need in the art for a balloon holder that can be shipped as separate stick portions and cup portions with those portions being joined with tight tolerances so that the assembly is stable, without significant wobbling or other movement between the stick portion and the cup portion. There is a need for a balloon holder with a combination of these properties.

SUMMARY OF THE INVENTION

In a first embodiment, the present invention provides a balloon holder comprising: a cup portion including: a stem having a barb extending therefrom, and a conical cup defined by a sidewall extending from said stem to define a top edge of said conical cup; and a stick portion including: an elongate stick body extending from a first end to a second end, a stem receptacle at said first end, and a barb receptacle provided in said stem receptacle, wherein a portion of said stem is received in said stem receptacle such that said barb locks into said barb receptacle to join said cup portion and said stick portion together to form a complete balloon holder.

In a second embodiment, the present invention provides a balloon holder as in the first embodiment, wherein the balloon holder is formed entirely of molded, non-moving parts.

In a third embodiment, the present invention provides a balloon holder as in any of the forgoing embodiments, wherein the cup portion and the stick portion are locked together and disjoined only by compromising the integrity of the barb or barb receptacle or stem receptacle.

In a fourth embodiment, the present invention provides a balloon holder as in any of the forgoing embodiments, wherein the barb includes a barb stop surface and said barb receptacle includes a receptacle stop surface, said barb stop surface engaging said receptacle stop surface upon an attempted removal of the stem axially out of the stem receptacle.

In a fifth embodiment, the present invention provides a balloon holder as in any of the forgoing embodiments, wherein said barb receptacle is an aperture through a sidewall of said stem receptacle.

In a sixth embodiment, the present invention provides a balloon holder as in any of the forgoing embodiments, wherein said receptacle stop surface is the surface defined by the thickness of said sidewall at said aperture.

In a seventh embodiment, the present invention provides a balloon holder as in any of the forgoing embodiments, wherein said aperture is circular or oval.

In an eighth embodiment, the present invention provides a balloon holder as in any of the forgoing embodiments, wherein said aperture is polygonal.

In a ninth embodiment, the present invention provides a balloon holder as in any of the forgoing embodiments, wherein said stop surface extends substantially orthogonal to the direction of removal of said stem from said step receptacle.

In a tenth embodiment, the present invention provides a balloon holder as in any of the forgoing embodiments, wherein said aperture is rectangular.

In an eleventh embodiment, the present invention provides a balloon holder as in any of the forgoing embodiments, wherein the stem has an outside perimeter, and the stem receptacle has an inside perimeter having tight tolerance with at least a portion of said outside perimeter of said stem so to stabilize the joinder of said cup portion as said stick portion.

In a twelfth embodiment, the present invention provides a balloon holder as in any of the forgoing embodiments, wherein said conical cup includes a support shoulder fitting with tight tolerance on an end face of said first end of said elongate stick body.

In a thirteenth embodiment, the present invention provides a balloon holder as in any of the forgoing embodiments, wherein said sidewall defining said conical cup includes is a conical sidewall having at least one slot therein, said slot extending downwardly from an opening at said top edge of said conical cup, and configured for receipt of a balloon neck.

In a fourteenth embodiment, the present invention provides a method of shipping and assembling balloon holders comprising the steps of: providing a plurality of cup portions, each including: a stem having a barb extending therefrom, and a conical cup defined by a sidewall extending from said stem to define a top edge of said conical cup; and providing a plurality of stick portions, each including: an elongate stick body extending from a first end to a second end, a stem receptacle at said first end, and a barb receptacle provided in said stem receptacle, shipping said plurality of cup portions together in a first package to an assembly site; shipping said plurality of stick portions together in a second package to an assembly site; assembling a balloon holder at said assembly site by inserting a portion of said stem in said stem receptacle such that said barb locks into said barb receptacle to join said cup portion and said stick portion together to form a complete balloon holder.

Additional embodiments of the method incorporate one or more aspects of the various embodiments disclosed above with respect to the balloon holder.

DETAILED DESCRIPTION OF ILLUSTRATIVE EMBODIMENTS

Figure 1:
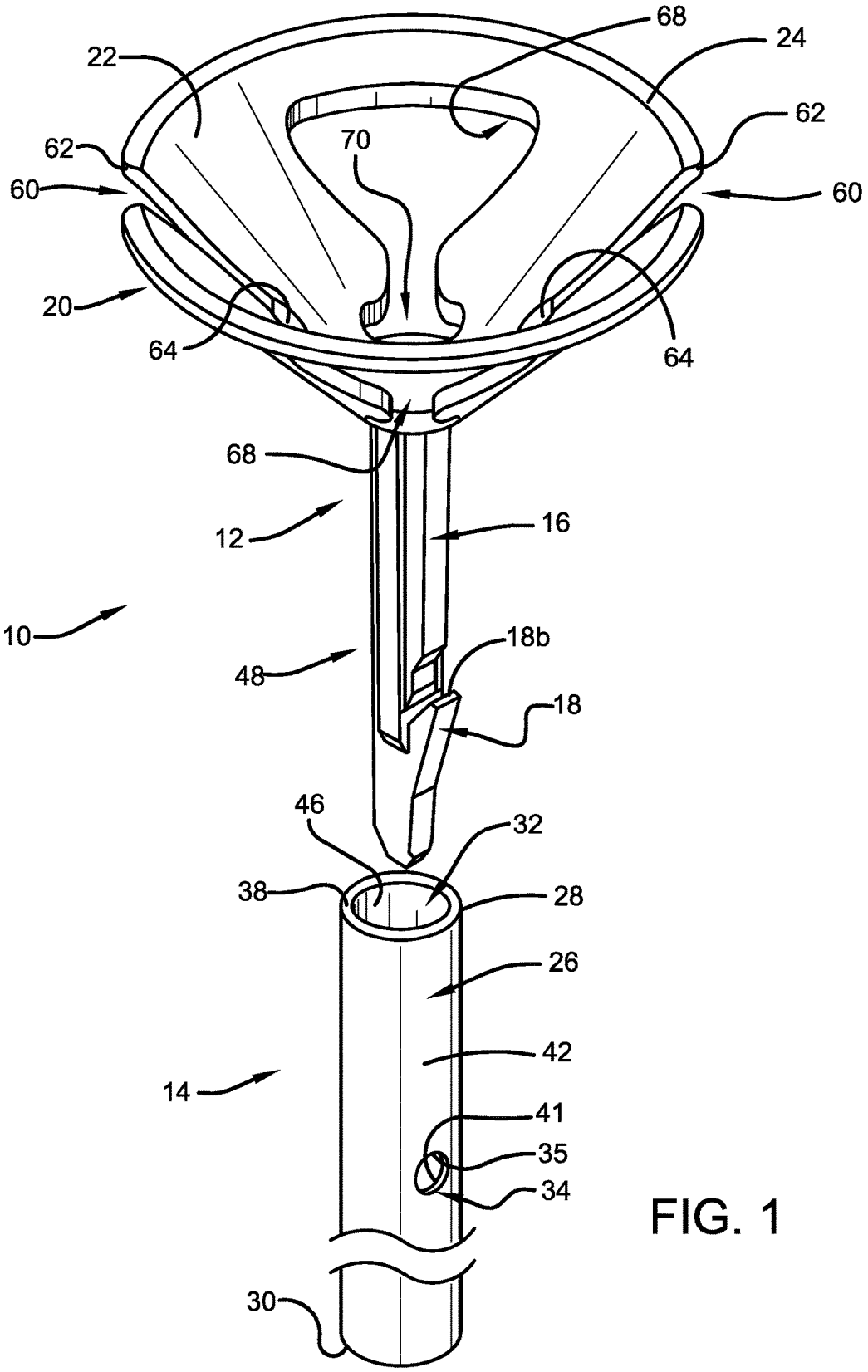
FIG. 1 is a perspective view showing the alignment of a cup portion and a stick portion for assembly to create an embodiment of a balloon holder of this invention.

With reference to FIGS. 1-5, a balloon holder in accordance with this invention is shown and designated by the numeral 10. The balloon holder 10 includes a cup portion 12 and a stick portion 14.

The cup portion 12 includes a stem 16 having a barb 18 extending therefrom, and a conical cup 20 defined by a sidewall 22 extending from the stem 16 to define a top edge 24 of the conical cup 20. The stick portion 14 includes an elongate stick body 26 extending from a first end 28 to a second end 30. A stem receptacle 32 is provided at the first end 28, and a barb receptacle 34 is provided in the stem receptacle 32.

Figure 5:
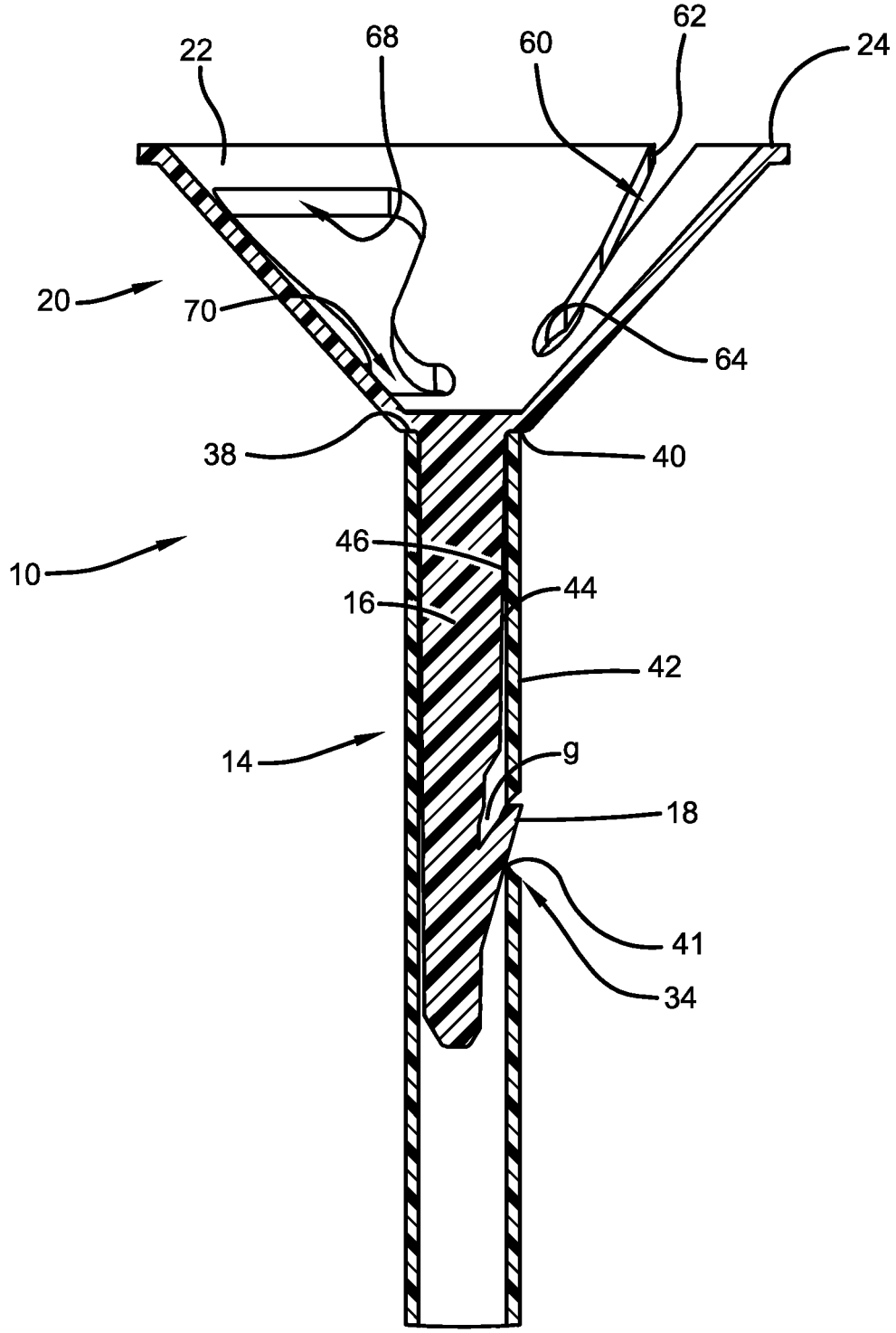
FIG. 5 is a cross-sectional view of a balloon holder in accordance with this invention.
Figure 6:
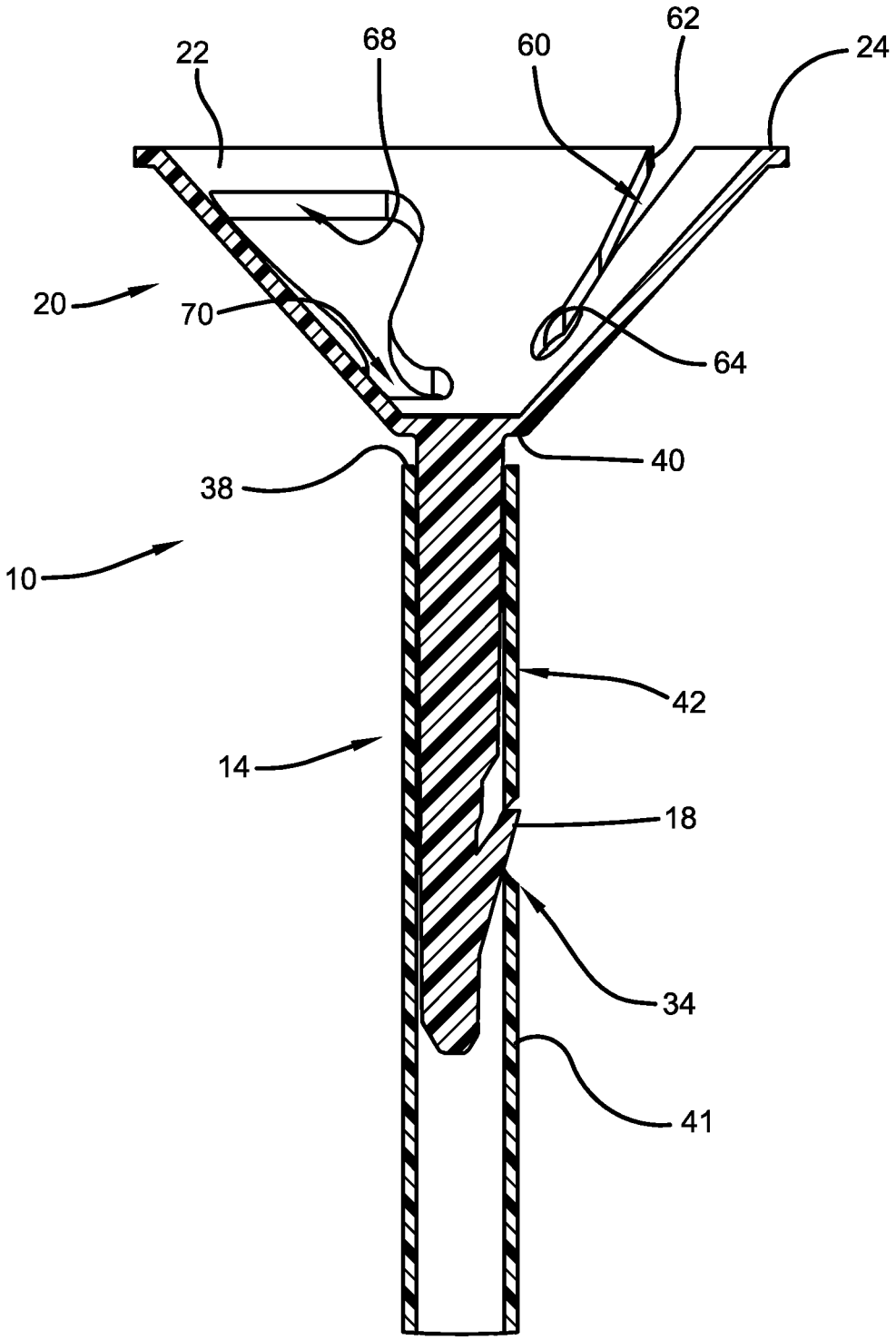
FIG. 6 is a cross-sectional view of a balloon holder in accordance with another embodiment of this invention.

In some embodiments, at least a portion of the stem 16 is received in the stem receptacle 32 such that the barb 18 locks into the barb receptacle 34 to join the cup portion 12 and the stick portion 14 together to form a complete balloon holder 10. In other embodiments, the entirety of the stem 16 is received in the stem receptacle 32 such that an end face 38 of the first end 28 of the elongate stick body 26 abuts the conical cup 20. In some embodiments, the entirety of the stem 16 is received in the stem receptacle 32 such that an end face 38 of the first end 28 of the elongate stick body 26 fits with tight tolerance on a support shoulder 40 of said conical cup 20 (FIG. 5). This stabilizes the joinder of the cup portion 12 and the stick portion 14. In some embodiment, such as that in FIG. 6, the end face 38 of the first end 28 is spaced from the conical cup 20.

Figure 4:
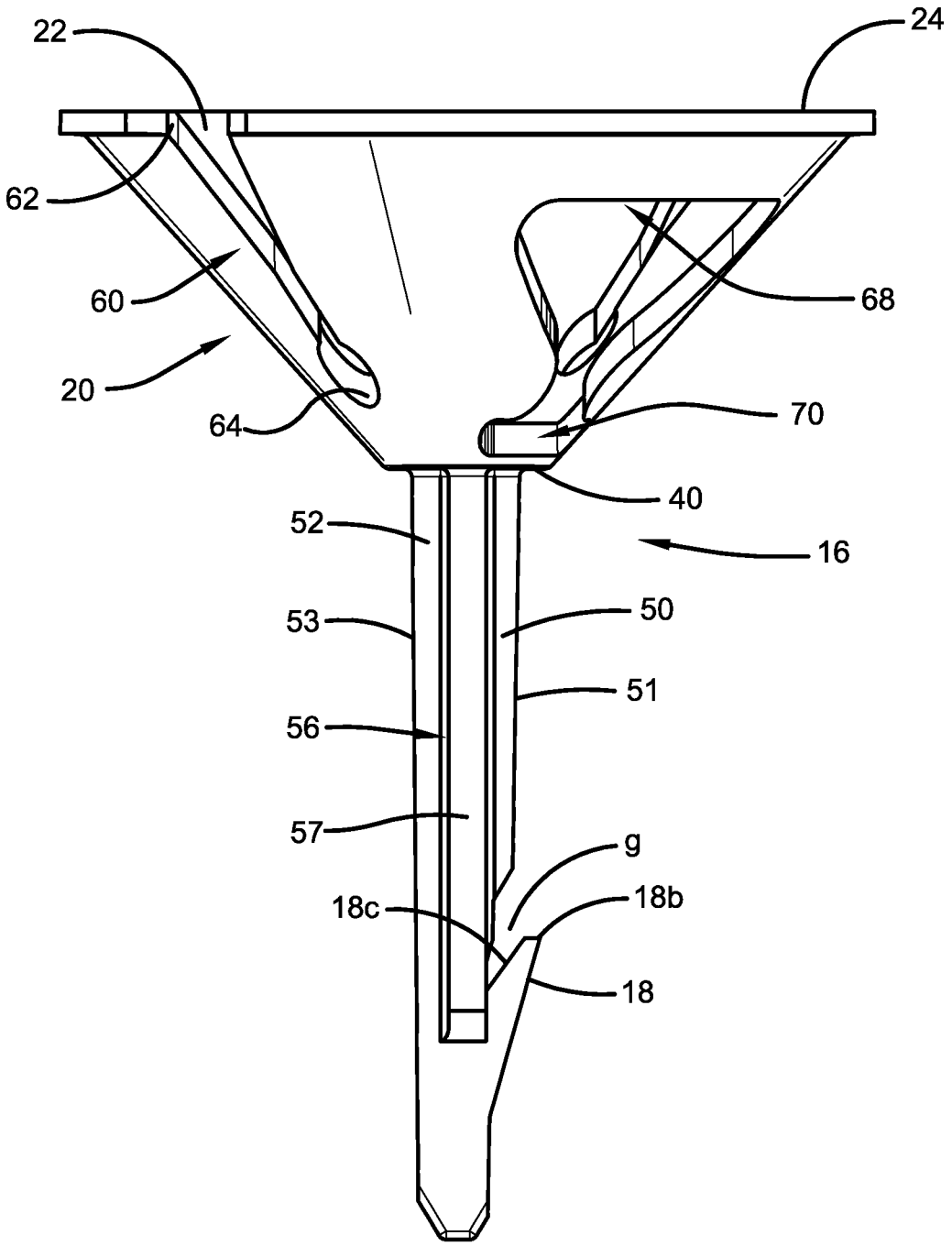
FIG. 4 is a side elevational view of the cup portion of FIG. 3.

In some embodiments, as perhaps best seen in FIG. 4, the barb 18 includes a sloped surface 18*a* and a stop surface 18*b*. The sloped surface 18*a* helps in permitting the feeding of the stem 16 in the stem receptacle 32, as the sloped surface 18*a* rides against the inside of the sidewall 42 of the step receptacle 32. In some embodiments, the barb 18 further defines an opposed sloped surface 18*c* that defines a gap g between the remainder of the stem 16 and the barb 18 thereof. With this structure, the barb 18 can deform inwardly toward the remainder of the stem 16 to accommodate insertion into the stem receptacle 32. Alternatively or in addition to the deformation of the barb 18, the wall of the stem 16 can flex/deform to facilitate passage of the barb 18, the sloped surface 18*c* facilitating this flexing/deformation. When the stem 16 is properly inserted into the stem receptacle 32, at least a portion of the barb 18 fits in the barb receptacle 34 with the stop surface 18*b* engaging a stop surface 35 of the barb receptacle 34 upon an attempted removal of the stem 16 axially out of the stem receptacle 34.

In some embodiments, the cup portion 12 and the stick portion 14 are locked together and disjoined only by compromising the integrity of the barb 18 or barb receptacle 34 or stem receptacle 32. That is, the barb effectively locks into the barb receptacle and cannot be removed absent applying inordinate amounts of force that cause warping (even if temporary) or breaking or other compromising of the integrity of the barb 18 or barb receptacle 34 or stem receptacle 32.

Figure 2:
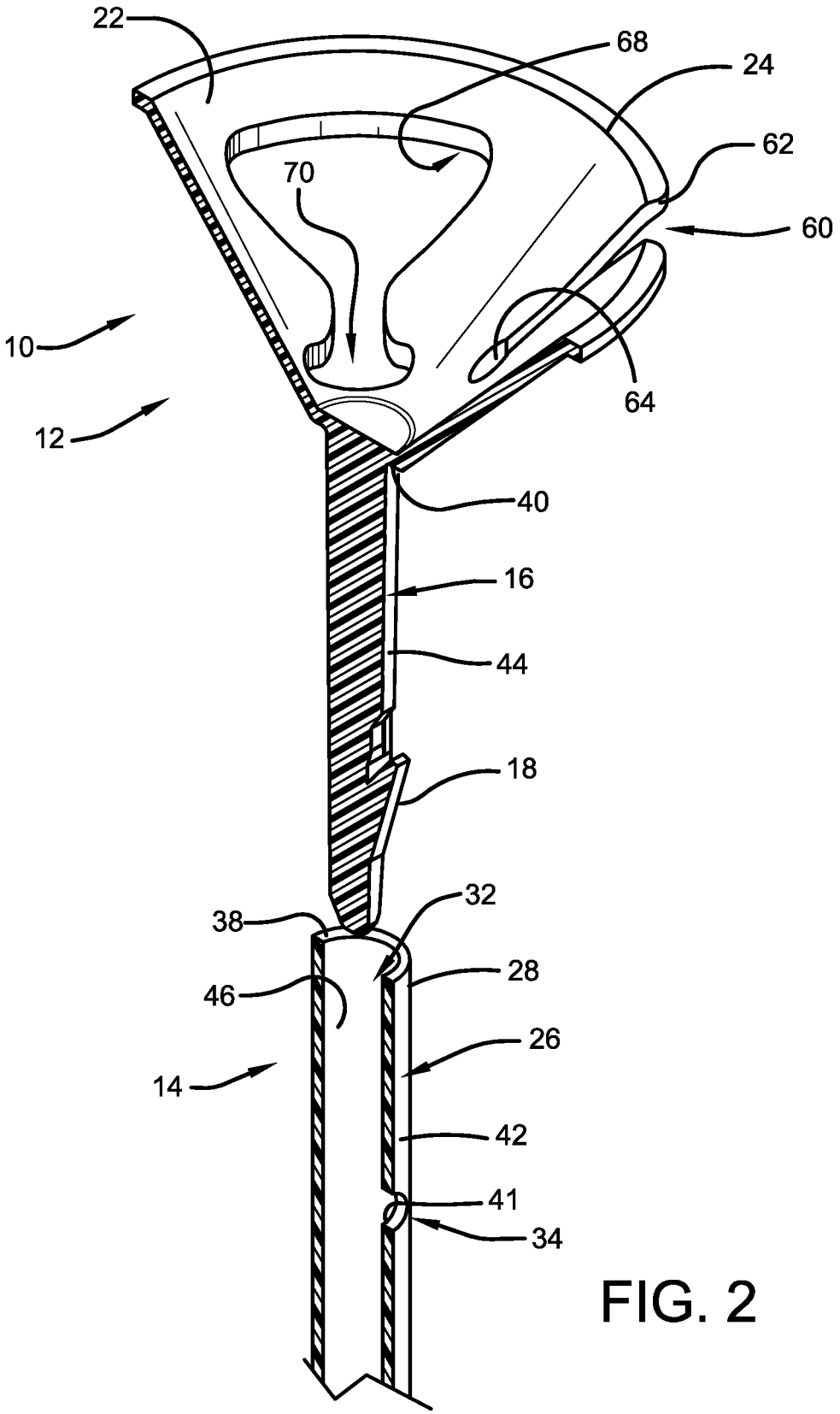
FIG. 2 is a cross-sectional view of FIG. 1.
Figure 3:
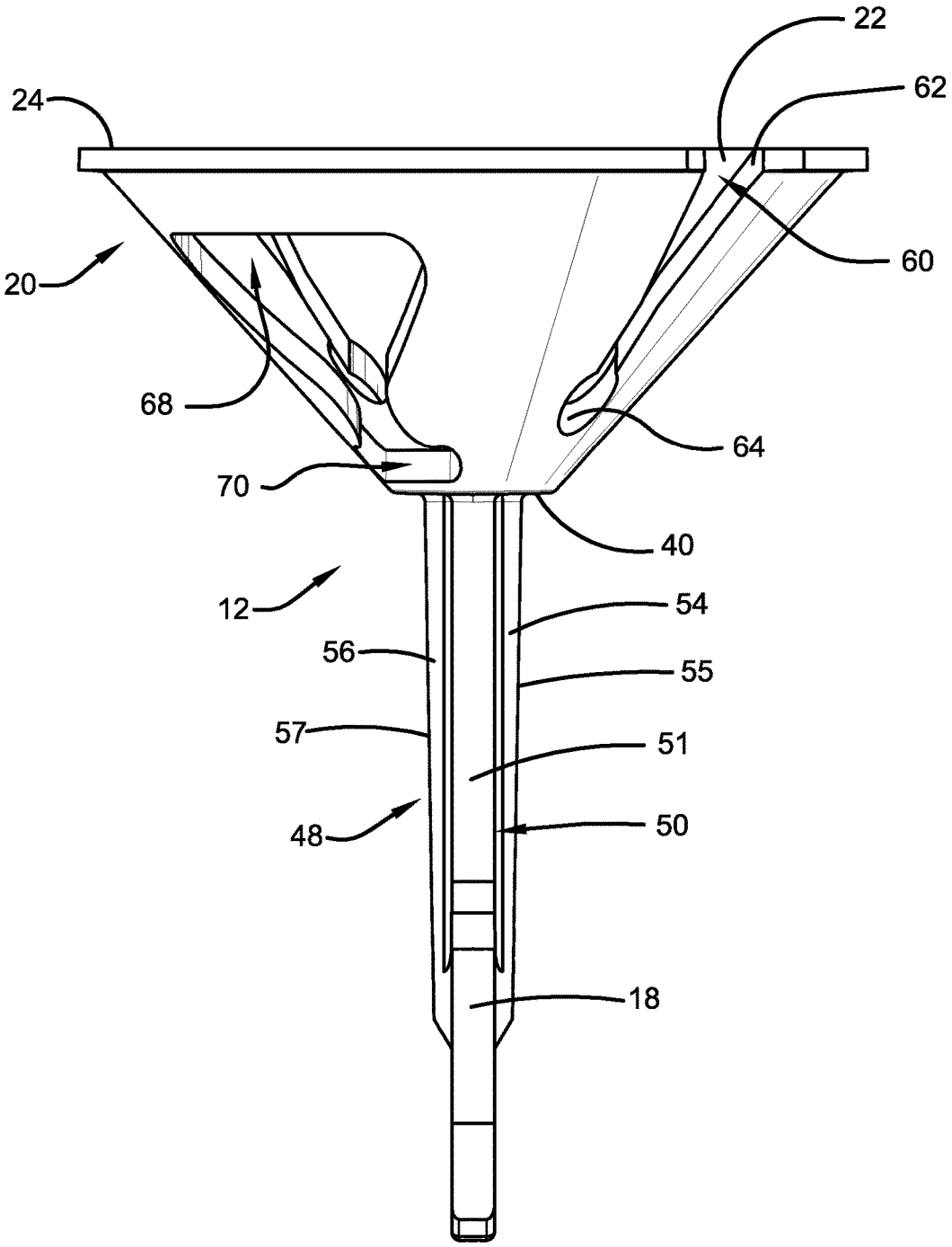
FIG. 3 is a front elevational view a cup portion in accordance with this invention.

In some embodiments, the barb receptacle 34 is an aperture 41 through a sidewall 42 of the stem receptacle 32. The aperture 41 presents the stop surface 35, which is the surface defined by the thickness of the sidewall 42 through which it extends. In some embodiments, the aperture 41 is circular, as seen in FIGS. 1 and 2, or might similarly be oval. In some oval embodiments the major axis of the oval is substantially orthogonal to the direction of attempted removal of the stem 16 from the stem receptacle 34.

Figure 8:
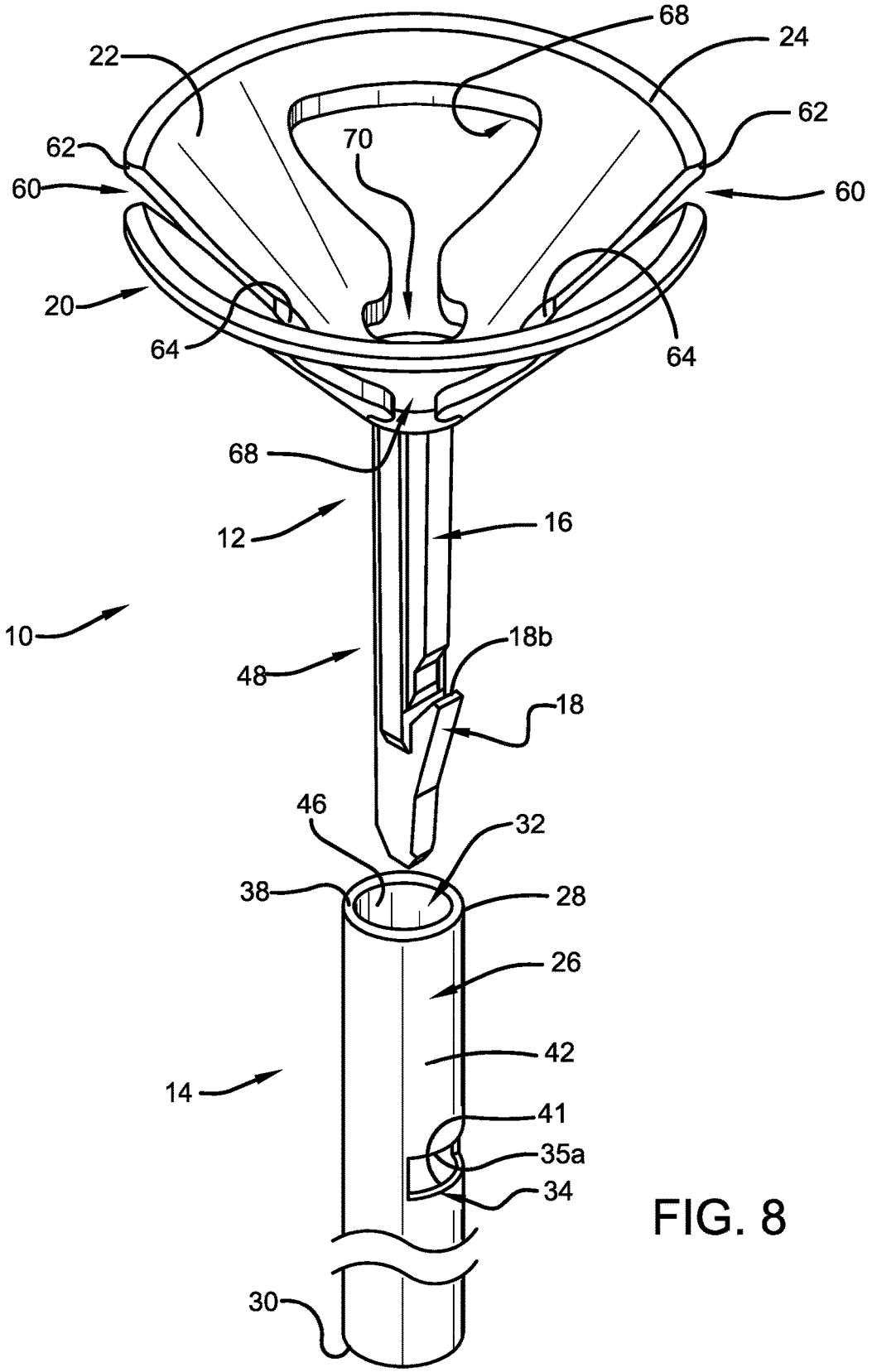
FIG. 8 is a perspective view showing the alignment of a cup portion and a stick portion for assembly, as in FIG. 1, but with the stick portion having a rectangular aperture therein.
Figure 9:
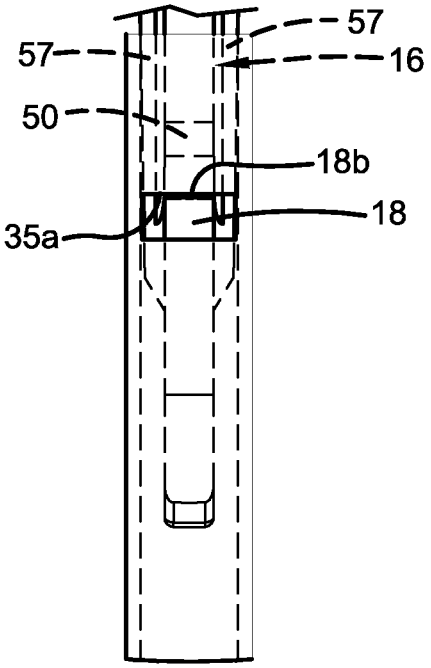
FIG. 9 is a front elevation view of the barb receptacle and barb interaction in an assembled version of the cup and stick portions of FIG. 8.

In some embodiments, the aperture is polygonal, as for example in FIG. 8, wherein the aperture 41*a* is rectangular. In such polygonal embodiments, it is preferred that the polygon present a stop surface, like stop surface 35*a*, that extends substantially orthogonal to the direction of attempted removal of the stem 16 from the stem receptacle 34. This type of stop surface, as exemplified with stop surface 35*a* in FIG. 9, will provide improved retention of the barb 18 in the barb receptacle 34 because the forces of the barb stop surface 18*b* against the receptacle stop surface 35 are substantially normal to the receptacle stop surface 35*a*.

In some embodiments, the barb 18 does not stick out beyond the outer surface 43 of the sidewall 42. In some embodiments, the barb 18 sticks out from the sidewall at less than 1 mm, and this "less than" limitation is to also include structures wherein the barb 18 does not stick out at all.

Figure 7:
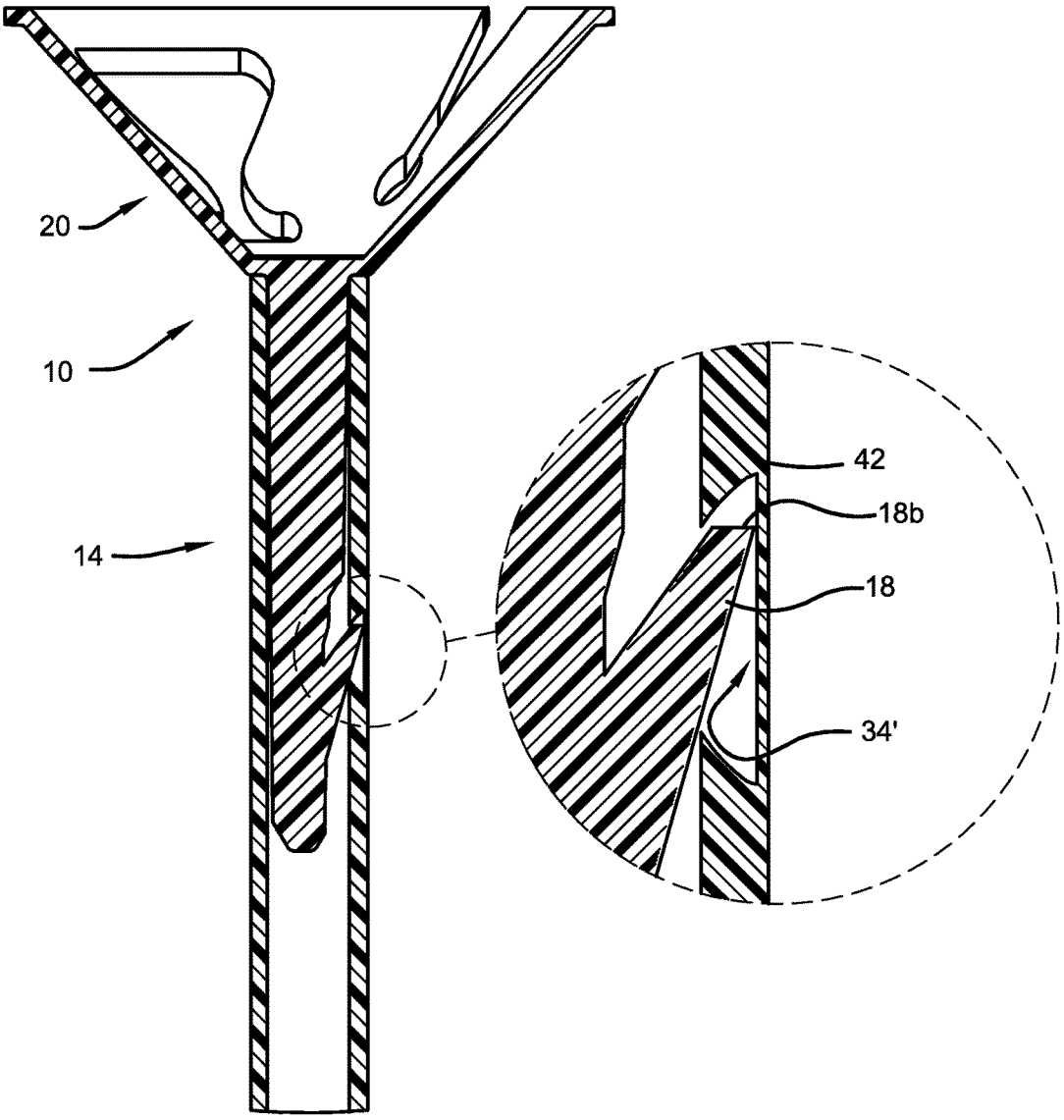
FIG. 7 is a cross-sectional view of another embodiment of this invention, and provides an enlarged view of a means for joining a cup portion and a stick portion of this invention.

In some embodiments, as shown in FIG. 7, the barb receptacle is a blind hole in the sidewall 42, as shown at 34'. A blind hole is a hole structured into a workpiece at a specific depth but without going through the workpiece. Here the workpiece is the stem receptacle 32 portion of the elongate body 26. By providing the barb receptacle 34' as a blind hole, the means of joinder is hidden, and the barb 18 cannot be accessed once the cup portion 12 and stick portion 14 are joined.

In some embodiments, the stem 16 has an outside perimeter 44 fitting with tight tolerance within an inside perimeter 46 of the stem receptacle 32 so to stabilize the joinder of the cup portion 12 and the stick portion 14. In some embodiments, this tight tolerance is achieved by an outside perimeter 44 that is within 0.007 inches of the inside perimeter 46, when the stick portion 14 is fitted to the stem 16. In other embodiments, the tight tolerance is achieved by an outside perimeter 44 that is within 0.005 inches of the inside perimeter 46, when the stick portion 14 is fitted to the stem 16. In circular stem 16 this will entail a difference in the outermost portions of the stick portion 14 defining the outside perimeter 44, and the inside diameter of the step receptacle 32 defining the inside perimeter 46, but non-circular stems and cups would fit with tight tolerances by having other non-circular complimentary shapes and sizes to satisfy the tight tolerances disclosed here. In other words, in some embodiments, tight tolerances are met by having less than 0.007 inches of potential movement between these elements when fitted together, in other embodiments, less than 0.005 inches. This can be achieved in any appropriate manner. Here, the stem 16 has a cross-shaped cross-section 48 and the distal ends 51, 53, 55, 57 of respective arms 50, 52, 54, 56 engage the inside perimeter 46 with tight tolerance. In some embodiments, the barb 18 is provided on one such arm, here arm 50.

In some embodiments, the barb 18 fits with tight tolerance in the barb receptacle 34. In some embodiments, this tight tolerance is achieved by a barb stop surface 18*b* that is within 0.007 inches of the stop surface (e.g. 35 and 35*a*) of the barb receptacle 34, when the stick portion 14 is fitted to the stem 16. In other embodiments, the tight tolerance is achieved by a barb stop surface 18*b* that is within 0.005 inches of the stop surface (e.g. 35 and 35*a*) of the barb receptacle 34, when the stick portion 14 is fitted to the stem 16. In other words, in some embodiments, tight tolerances are met by having less than 0.007 inches of potential movement between these elements when fitted together, in other embodiments, less than 0.005 inches.

In some embodiments, the stick portion is formed of a material having a flex modulus of greater than 50 ksi (thousands of pounds per square inch). In other embodiments, the stick portion is formed of a material having a flex modulus of greater than 100 ksi, in other embodiments, greater than 150 ksi, in other embodiments, greater than 200 ksi, in other embodiments, greater than 250 ksi, in other embodiments, greater than 300 ksi, in other embodiments, greater than 350 ksi, in other embodiments, greater than 400 ksi, and, in other embodiments, greater than 450 ksi.

In some embodiments, the stick portion is formed of a material having a flex modulus of less than 500 ksi (thousands of pounds per square inch). In other embodiments, the stick portion is formed of a material having a flex modulus of less than 450 ksi, in other embodiments, less than 400 ksi, in other embodiments, less than 350 ksi, in other embodiments, less than 300 ksi, in other embodiments, less than 250 ksi, in other embodiments, less than 200 ksi, in other embodiments, less than 1500 ksi, and, in other embodiments, less than 100 ksi.

In some embodiments, the stick portion is formed of a material having a flex modulus of from 50 ksi or more to 500 ksi or less. In other embodiments, the stick portion is formed of a material having a flex modulus of from 75 to 350 ksi, in other embodiments, from 100 to 300 ksi, in other embodiments, from 150 to 275 ksi, and, in other embodiments, from 200 to 250 ksi.

In some embodiments, the stick portion is formed of polypropylene. In some embodiments, the stick portion is formed of polypropylene according to any of the flex modulus embodiments mentioned immediately above.

In some embodiments, the stem of the cup portion is formed of a material having a flex modulus of greater than 100 ksi (thousands of pounds per square inch). In other embodiments, the stem portion is formed of a material having a flex modulus of greater than 150 ksi, in other embodiments, greater than 200 ksi, and, in other embodiments, greater than 250 ksi.

In some embodiments, the stem portion is formed of a material having a flex modulus of less than 300 ksi (thousands of pounds per square inch). In other embodiments, the stem portion is formed of a material having a flex modulus of less than 250 ksi, in other embodiments, less than 200 ksi, and, in other embodiments, less than 150 ksi.

In some embodiments, the stem portion is formed of a material having a flex modulus of from 100 ksi or more to 300 ksi or less. In other embodiments, the stem portion is formed of a material having a flex modulus of from 75 to 300 ksi, in other embodiments, from 100 to 300 ksi, in other embodiments, from 150 to 275 ksi, and, in other embodiments, from 200 to 250 ksi.

In some embodiments, the stem portion is formed of polypropylene. In some embodiments, the stem portion is formed of polypropylene according to any of the flex modulus embodiments mentioned immediately above. In some embodiment, the entire cup portion is polypropylene. In some embodiment, the entire cup portion is polypropylene having a flex modulus according to any of the embodiments immediately above.

In some embodiments, the cup portion 12 has one or more sealing slits 60 extending from an open end 62 at the top edge 24 to a closed end 64 further down the sidewall 22. In some embodiments, the closed end 64 is closed in the form of virtually any shape. In a particular embodiment, the close end 64 is closed in a rounded or semi-circular shape, as shown. In some embodiments, the cup portion 12 has two sealing slits 60 (as shown), preferably opposed for purposes of symmetry. The two sealing slits 60 are spaced apart from one another to define a neck wrap portion 66 of the cup portion 12. The sealing slits 60 can be used to wrap a balloon neck around the cup portion 12 and secure a balloon to the balloon holder in a generally known manner.

In some embodiments, the cup portion includes one or more neck apertures 68 in the sidewall 22. The neck aperture 68 defines a neck-receiving slot 70. In some embodiments, the cup portion 12 has two neck apertures 68 (as shown), preferably opposed for purposes of symmetry. The sealing slits 60 can be used to wrap a balloon neck around the cup portion 12 and secure a balloon to the balloon holder in a generally known manner.

Figure 10:
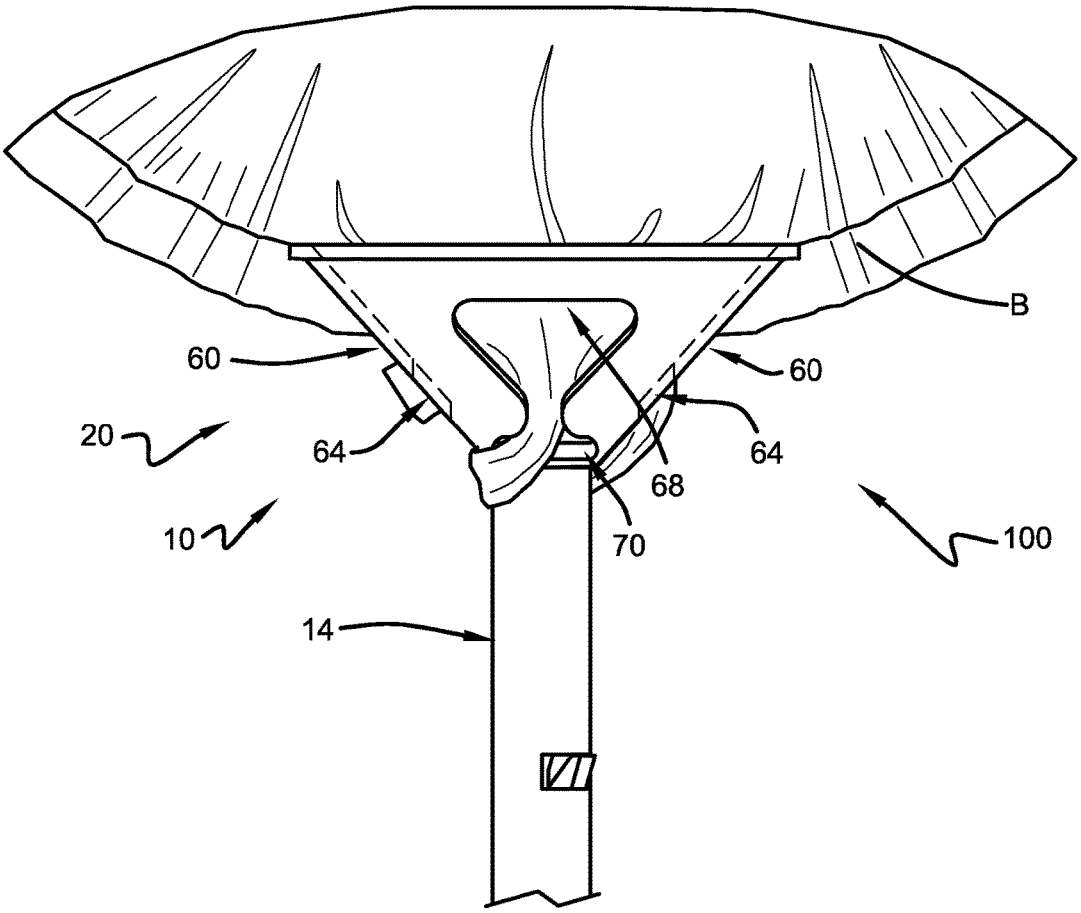
FIG. 10 is an embodiment of a balloon display in accordance with this invention.

In a particular embodiment exemplified in FIG. 10, a balloon neck is (1) pulled through a first one of the neck apertures 68, (2) wrapped around at least a portion of the base of the conical cup 20 or the top of the stem 16 or the top of the stick portion 18 (if already assembled as a balloon holder 10, as in FIG. 10), (3) brought back up through a first one of the sealing slits 60, (4) passed through the conical cup 20, (5) brought back down through a second one of the sealing slits 60, with the tension of the neck being sufficient to hold the balloon in the conical cup 20 and seal the balloon. This is generally known, but is disclosed here for those unfamiliar with this common aspect of the present invention. A balloon mounted in this way is shown in FIG. 10, which provides a balloon display 100 that is a combination of the balloon holder 10 and a balloon B.

Figure 11:
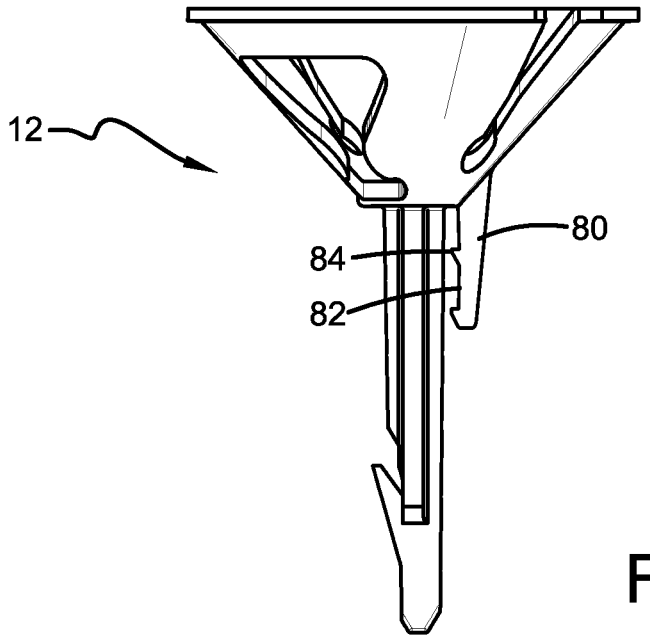
FIG. 11 is a side elevational view of a second embodiment of a cup portion in accordance with this invention, the cup portion including a neck-gripping finger.
Figure 12:
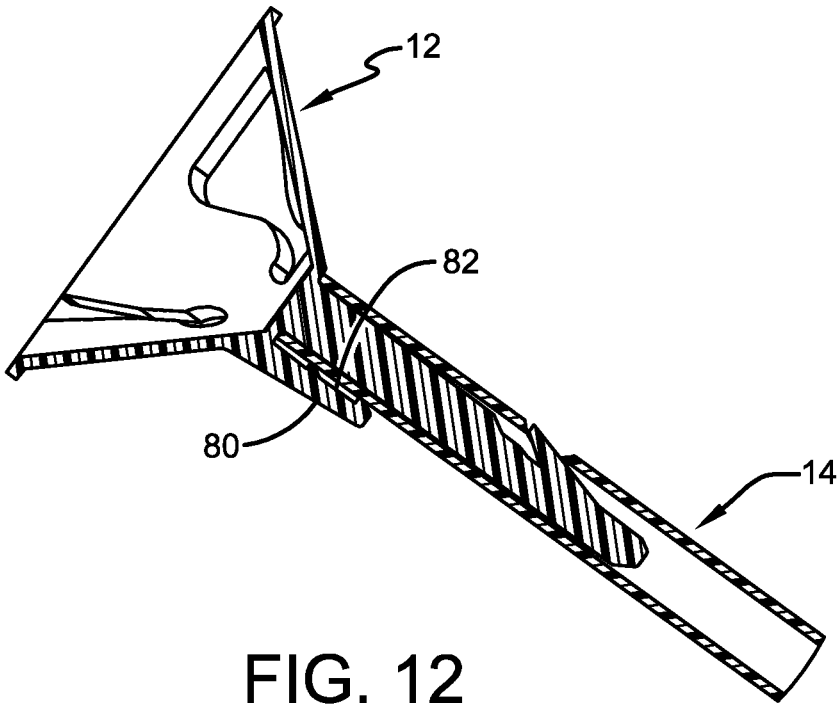
FIG. 12 is a cross-sectional view of a balloon holder in accordance with this invention, but using the cup portion of FIG. 11.

In other embodiments, as exemplified in FIGS. 11 and 12, the cup portion 12 can further include a neck-gripping finger 80 extending down to provide a grip surface 82 in close proximity to the outer surface of the stem portion 12, and, more specifically, in close proximity to the outer surface of the stick portion 14, in order to grip a neck of a balloon. This is of particular use with balloons having short necks that are not easily manipulated (or simply are not long enough to be manipulated) to secure as shown in FIG. 10. The neck would be (1) pulled through a first one of the neck apertures 68, (2) wrapped around at least a portion of the base of the conical cup 20 or the top of the stem 16 or the top of the stick portion 18 (if already assembled as a balloon holder 10, as in FIG. 10), but, being not of sufficient length to be placed through a sealing slit and passed through the conical cup and brought back down through a second sealing slit, would thereafter be inserted between the grip surface 82 of the neck-gripping finger 80 and the outer surface of the stick portion 14. The grip surface 82 can in some embodiments provide a barb 84 extending to even closer proximity to the stem portion 12, and, when assembled, to the outer surface of the stick portion 14. In some embodiments, the barb 84 extends to contact the outer surface of the stick portion 14. Balloon with shorter necks, can have their necks partially wrapped around at least a portion of the base of the conical cup 20 or the top of the stem 16 or the top of the stick portion 18 (if already assembled as a balloon holder 10, as in FIG. 10), and then secured at the neck-gripping finger 80, simply by the thickness and/or bunching up of the material between the grip surface 82 and the cup 20 and/or stem 16 and/or stick portion 18.

In some embodiments in accordance with any of the forgoing, the cup portion 12 and the stick portion 14 of the balloon holder 10 are molded parts and, once joined to form the balloon holder 10 are non-moving parts. By "non-moving parts" it is meant that the cup portion 12 and the stick portion 14 fit together to form the balloon holder 10 without substantial movement between the two portions, except for the ability to be slightly moved in accordance with the types of tight tolerances referenced above. In some embodiments, the stick portions are extrusion molded and the cup portions are injection molded. In some embodiments, the stick portions are one-piece elements, and in some embodiments, the cup portions are one-piece elements, and, in some embodiments, both the stick and cup portions are one-piece elements.

With the disclosure of the structure of the present invention, it is also clear that this invention provides a method of shipping and assembling balloon holders comprising the steps of: providing a plurality of cup portions, each including: a stem having a barb extending therefrom, and a conical cup defined by a sidewall extending from said stem to define a top edge of said conical cup; and providing a plurality of stick portions, each including: an elongate stick body extending from a first end to a second end, a stem receptacle at said first end, and a barb receptacle provided in said stem receptacle, shipping said plurality of cup portions together in a first package to an assembly site; shipping said plurality of stick portions together in a second package to an assembly site; and assembling a balloon holder at said assembly site by inserting a portion of said stem in said stem receptacle such that said barb locks into said barb receptacle to join said cup portion and said stick portion together to form a complete balloon holder.

In light of the foregoing, it should be appreciated that the present invention significantly advances the art by providing a balloon holder that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A balloon holder comprising:
- a cup portion including:
  - a stem having a barb extending therefrom, and
  - a conical cup defined by a sidewall extending from said stem to define a top edge of said conical cup; and
- a stick portion including:
  - an elongate stick body extending from a first end to a second end,
  - a stem receptacle at said first end, and
  - a barb receptacle provided in said stem receptacle,
- wherein a portion of said stem is received in said stem receptacle such that said barb locks into said barb receptacle to join said cup portion and said stick portion together to form a complete balloon holder, wherein said cup portion and said stick portion are locked together and disjoined only by compromising the integrity of the barb or barb receptacle or stem receptacle.

2. The balloon holder of claim 1, wherein the individual components of the balloon holder are all formed entirely of molded parts.

3. The balloon holder of claim 2, wherein the balloon holder consists solely of said cup portion and said stick portion.

4. The balloon holder of claim 1, wherein said barb includes a barb stop surface and said barb receptacle includes a receptacle stop surface, said barb stop surface engaging said receptacle stop surface upon an attempted removal of the stem axially out of the stem receptacle.

5. The balloon holder of claim 4, wherein said barb receptacle is an aperture through a sidewall of said stem receptacle.

6. The balloon holder of claim 5, wherein said receptacle stop surface is the surface defined by the thickness of said sidewall at said aperture.

7. The balloon holder of claim 5, wherein said aperture is circular or oval.

8. The balloon holder of claim 5, wherein said aperture is polygonal.

9. The balloon holder of claim 8, wherein said stop surface extends substantially orthogonal to the direction of removal of said stem from said step receptacle.

10. The balloon holder of claim 9, wherein said aperture is rectangular.

11. The balloon holder of claim 10, wherein the stem has an outside perimeter, and the stem receptacle has an inside perimeter having tight tolerance with at least a portion of said outside perimeter of said stem so to stabilize the joinder of said cup portion as said stick portion.

12. The balloon holder of claim 11, wherein said conical cup includes a support shoulder fitting with tight tolerance on an end face of said first end of said elongate stick body.

13. The balloon holder of claim 12, wherein said sidewall defining said conical cup includes a conical sidewall having at least one slot therein, said slot extending downwardly from an opening at said top edge of said conical cup, and configured for receipt of a balloon neck.

* * * * *